US009960501B2

(12) United States Patent
Hsieh et al.

(10) Patent No.: US 9,960,501 B2
(45) Date of Patent: May 1, 2018

(54) ELECTRONIC DEVICE, COMMUNICATION DEVICE, AND ANTENNA GAIN ENHANCEMENT METHOD FOR A DETACHABLE WIRELESS COMMUNICATION MODULE

(71) Applicant: Quanta Computer Inc., Taoyuan (TW)

(72) Inventors: Tsung-Ying Hsieh, Taoyuan (TW); Li-Cheng Shen, Taoyuan (TW); Chung-Ting Hung, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 323 days.

(21) Appl. No.: 14/883,936

(22) Filed: Oct. 15, 2015

(65) Prior Publication Data

US 2017/0040712 A1 Feb. 9, 2017

(30) Foreign Application Priority Data

Aug. 6, 2015 (TW) ..... 104125562 A

(51) Int. Cl.
*H01Q 21/00* (2006.01)
*H01Q 21/28* (2006.01)
*H01Q 1/22* (2006.01)

(52) U.S. Cl.
CPC ..... *H01Q 21/28* (2013.01); *H01Q 1/2275* (2013.01)

(58) Field of Classification Search
CPC ..... H01Q 21/06; H01Q 3/26; H01Q 1/246; H01Q 21/28
USPC ..... 343/893, 725, 853, 879
See application file for complete search history.

(56) References Cited

U.S. PATENT DOCUMENTS

2010/0165584 A1* 7/2010 Koyama ..... G06F 1/1698 361/748
2012/0235868 A1* 9/2012 Oshiro ..... H01Q 1/243 343/702
2013/0249744 A1 9/2013 Jang et al.

FOREIGN PATENT DOCUMENTS

TW 520583 2/2003

OTHER PUBLICATIONS

Chinese language office action dated Nov. 10, 2016, issued in application No. TW 104125562.

* cited by examiner

*Primary Examiner* — Dameon E Levi
*Assistant Examiner* — Collin Dawkins
(74) *Attorney, Agent, or Firm* — McClure, Qualey & Rodack, LLP

(57) ABSTRACT

The present invention presents an electronic device. The electronic device includes a socket and a supplementary antenna. The socket is disposed on the electronic device, wherein the socket includes an accommodating portion for accommodating an external wireless communication module inserted from the outside. The supplementary antenna is disposed in the electronic device, wherein when the wireless communication module is completely inserted into the accommodating portion, the main antenna of the wireless communication module and the supplementary antenna become electromagnetically coupled; and wherein when the wireless communication module is completely inserted into the accommodating portion, the electronic device transmits/receives wireless signals using the main antenna and the supplementary antenna together.

3 Claims, 8 Drawing Sheets

ELECTRONIC DEVICE, COMMUNICATION DEVICE, AND ANTENNA GAIN ENHANCEMENT METHOD FOR A DETACHABLE WIRELESS COMMUNICATION MODULE

CROSS REFERENCE TO RELATED APPLICATIONS

This application claims priority of Taiwan Patent Application No. 104125562, filed on Aug. 6, 2015, the entirety of which is incorporated by reference herein.

BACKGROUND OF THE INVENTION

Field of the Invention

The technical field relates to an application of a computer device and a detachable wireless communication module, and more particularly to antenna design of the computer device and the detachable wireless communication module.

Description of the Related Art

A wireless communication module (or radio frequency module) is a small electronic device used to transmit and/or receive radio signals between two devices. The wireless communication module is often designed to have a compact size so as to be easy to carry. Hence, the antenna of the wireless communication module cannot be designed to be the most appropriate size due to space limitations in the wireless communication module. Because low-frequency antennas need much more space, the above disadvantage becomes more apparent. In view of this, the present invention provides a communication device and the corresponding antenna gain enhancement method for a detachable wireless communication module.

BRIEF SUMMARY OF THE INVENTION

A detailed description is given in the following embodiments with reference to the accompanying drawings.

An embodiment of the present invention provides an electronic device. The electronic device comprises a socket and a supplementary antenna. The socket is disposed on the electronic device, wherein the socket comprises an accommodating portion for accommodating an external wireless communication module inserted from the outside. The supplementary antenna is disposed in the electronic device, wherein when the wireless communication module is completely inserted into the accommodating portion, the main antenna of the wireless communication module and the supplementary antenna become electromagnetically coupled; and wherein when the wireless communication module is completely inserted into the accommodating portion, the electronic device transmits/receives wireless signals using both the main antenna and the supplementary antenna.

An embodiment of the present invention provides a communication device. The communication device comprises a detachable wireless communication module and an electronic device. The detachable wireless communication module comprises a main antenna. The electronic device comprises a socket and a supplementary antenna. The socket is disposed on the electronic device, wherein the socket comprises an accommodating portion for accommodating the detachable wireless communication module inserted from the outside. The supplementary antenna is disposed in the electronic device, wherein when the detachable wireless communication module is completely inserted into the accommodating portion, the main antenna of the wireless communication module and the supplementary antenna become electromagnetically coupled; and wherein when the detachable wireless communication module is completely inserted into the accommodating portion, the communication device transmits/receives wireless signals using the main antenna and the supplementary antenna.

An embodiment of the present invention provides an antenna gain enhancement method for a detachable wireless communication module. The antenna gain enhancement method comprises disposing a socket on an electronic device, wherein the socket comprises an accommodating portion for accommodating the detachable wireless communication module inserted from the outside; disposing a supplementary antenna in the electronic device; and inserting the detachable wireless communication module into the accommodating portion so that the main antenna of the wireless communication module and the supplementary antenna are electromagnetically coupled, wherein when the detachable wireless communication module is completely inserted into the accommodating portion, the detachable wireless communication module transmits/receives wireless signals using the main antenna and the supplementary antenna.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the present disclosure. This description is made for the purpose of illustrating the general principles of the present disclosure and should not be taken in a limiting sense. The scope of the present disclosure is best determined by reference to the appended claims.

Figure 1A:
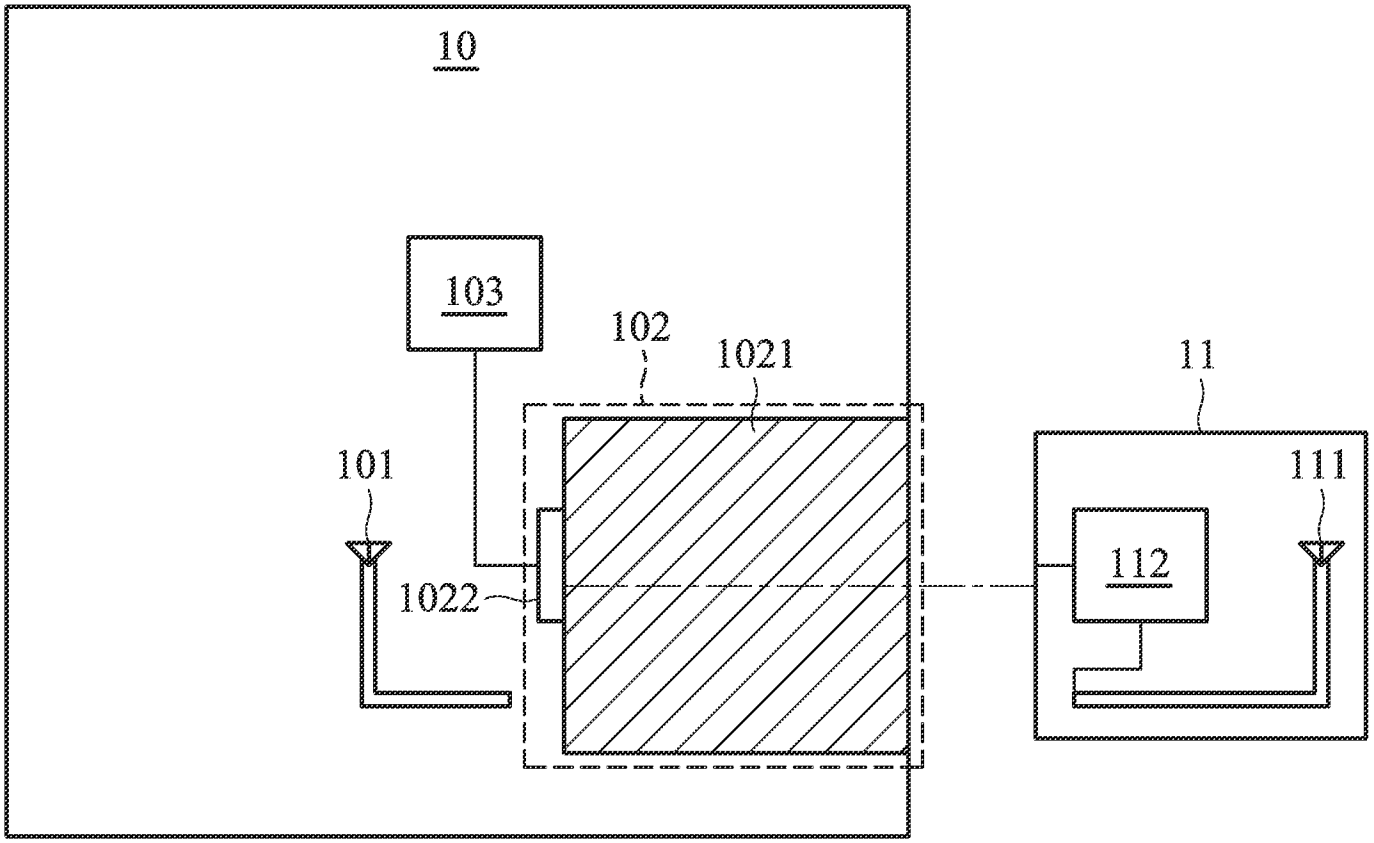
FIG. 1A is a block diagram showing an electronic device 10 and a wireless communication module 11 according to a first embodiment of the present invention.

FIG. 1A is a block diagram showing an electronic device 10 and a wireless communication module 11 according to a first embodiment of the present invention. In the first embodiment, the electronic device 10 comprises a supplementary antenna 101, a socket 102, and a processor 103, and the wireless communication module 11 comprises a main antenna 111 and a radio frequency module 112. The socket 102 comprises an accommodating portion 1021 and a transmit interface 1022, wherein the accommodating portion 1021 is used for accommodating the wireless communication module 11 inserted from the outside. In the first embodiment, the accommodating portion 1021 is sufficiently large to completely accommodate the wireless communication module 11. In the first embodiment, the electronic device 10 can be a notebook, the transmit interface 1022 can be a universal serial bus (USB) interface, the processor 103 can be a central processor, and the wireless communication module 11 can be a detachable wireless communication module with an USB plug, but the present invention is not limited thereto. The supplementary antenna 101 is disposed in the electronic device 10 (i.e., disposed inside the electronic device 10). The radio frequency module 112 of the wireless communication module 11 is used to process electromagnetic signals received from the antenna or used to control the antenna to transmit electromagnetic signals. In the first embodiment, when the wireless communication module 11 is completely inserted into the accommodating portion 1021 of the socket 102, the main antenna 111 of the wireless communication module 11 and the supplementary antenna 101 become electromagnetically coupled. At this time, the electronic device 10 transmits/receives wireless signals by using the main antenna 111 together with the supplementary antenna 101. In the first embodiment, when the wireless communication module 11 is completely inserted into the accommodating portion 1021 of the socket 102, the processor 103 of the electronic device 10 is electrically connected to the radio frequency module 112 of the wireless communication module 11 through the transmit interface 1022.

In the first embodiment, the wireless communication module 11 also can be applied into general electronic devices which have USB interface so that the general electronic devices transmits/receives wireless signals through the wireless communication module 11 (i.e., performing wireless communication). The wireless communication module 11 is often preferably designed to have a compact size so as to be easy to carry. Meanwhile, the antenna size of the wireless communication module 11 cannot be designed as the most appropriate size due to limited space in the wireless communication module 11. The above disadvantage becomes more apparent when the main antenna 111 needs to be designed with a larger size for transmitting/receiving low-frequency wireless signals. In order to solve the problem of having too little space in the layout for the antenna, the electronic device 10 disclosed in the first embodiment of the present invention enhances the antenna gain by transmitting/receiving wireless signals by the main antenna 111 and the supplementary antenna 101 together. Accordingly, compared with only using the main antenna 111 to transmit/receive wireless signals, the electronic device 10 can obtain better signal quality by transmitting/receiving wireless signals via the main antenna 111 and the supplementary antenna 101. In the first embodiment, the electromagnetic coupling of the main antenna 111 and the supplementary antenna 101 comprises two methods: those of direct electrical connection and non-contact electromagnetic coupling. These will be described in subsequent paragraphs.

Figure 1B:
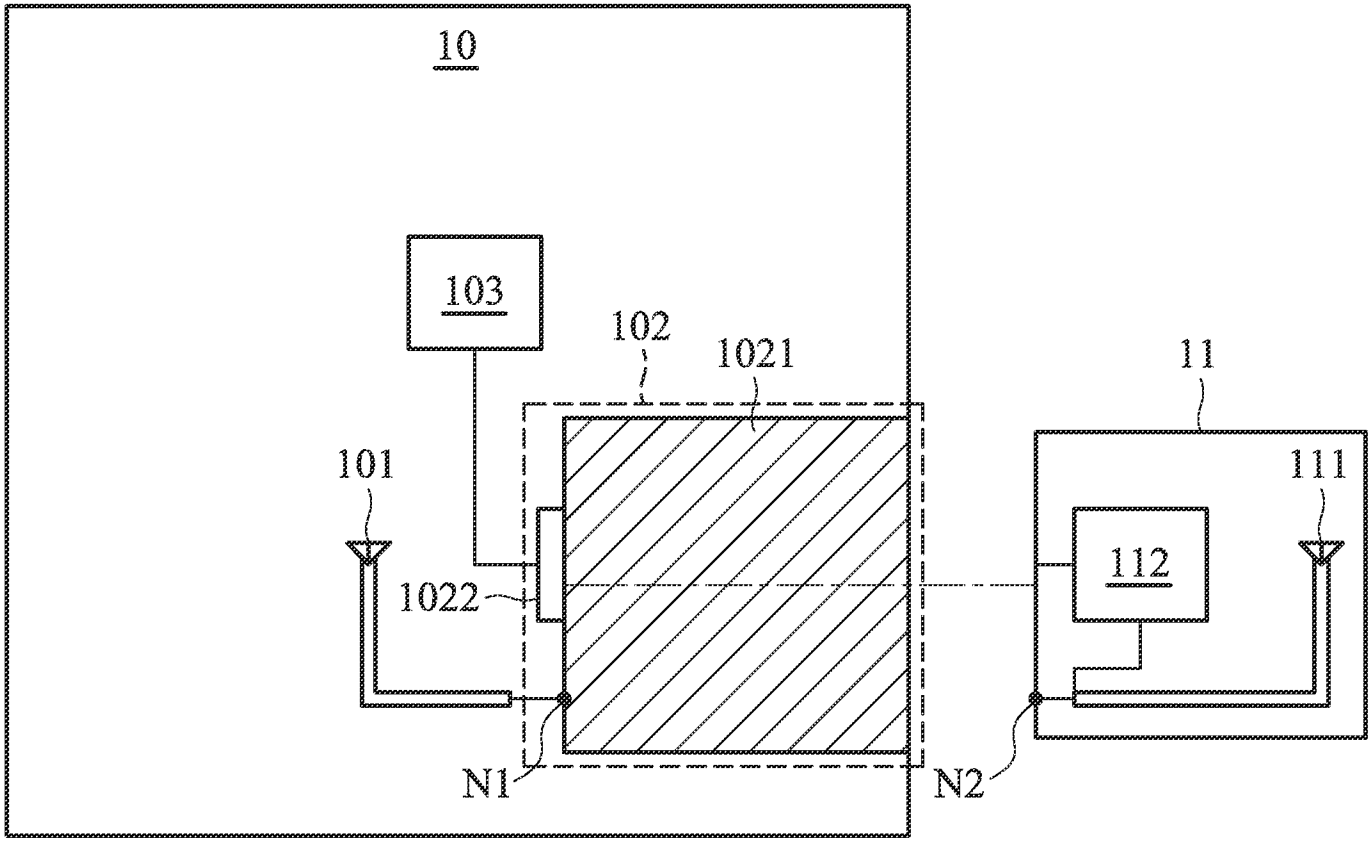
FIG. 1B and FIG. 1C are schematic diagrams illustrating how to electromagnetically couple the main antenna 111 and the supplementary antenna 101 according to a second embodiment of the present invention.
Figure 1C:
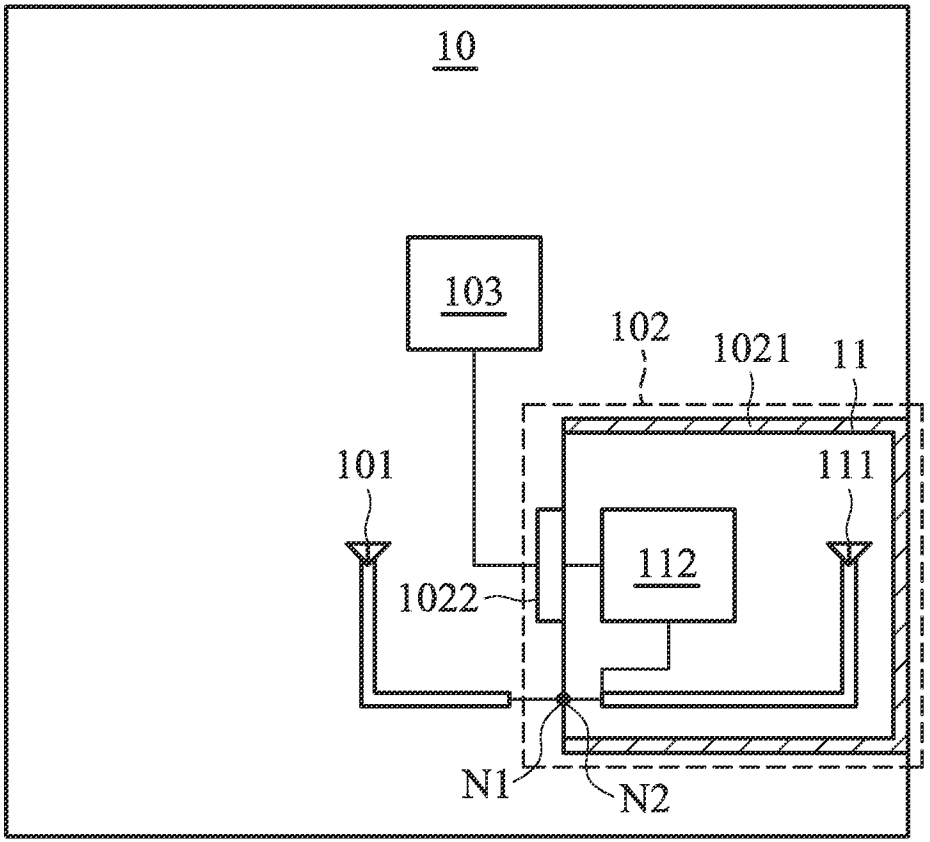

FIG. 1B and FIG. 1C are schematic diagrams illustrating how the main antenna 111 and the supplementary antenna 101 become electromagnetically coupled according to a second embodiment of the present invention. As shown in FIG. 1B of the second embodiment of the present invention, the socket 102 further comprises a first electrical node N1. The wireless communication module 11 comprises a second electrical node N2 electrically connected to the main antenna 111. In the second embodiment, the first electrical node N1 of the socket 102 is electrically connected to the supplementary antenna 101.

Then as shown in FIG. 1C of the second embodiment, when the wireless communication module 11 is completely inserted into the accommodating portion 1021 of the socket 102, the first electrical node N1 of the socket 102 is electrically connected to the second electrical node N2 of the wireless communication module 11 so that the supplementary antenna 101 is directly electrically connected to the main antenna 111 of the wireless communication module 11. Accordingly, in the second embodiment of the present invention, the main antenna 111 and the supplementary antenna 101 are electromagnetically coupled by way of a direct electrical connection.

Figure 1D:
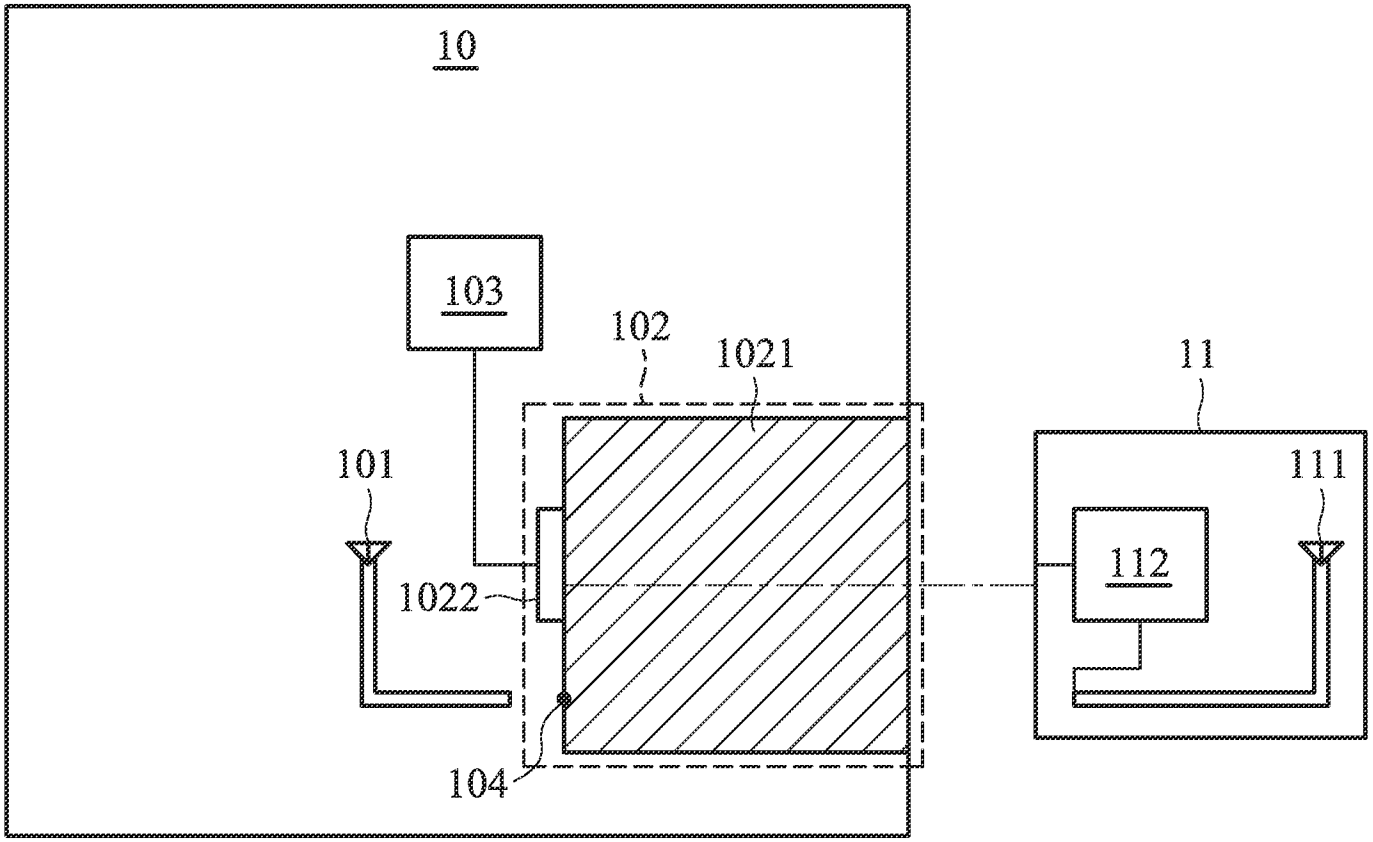
FIG. 1D and FIG. 1E are schematic diagrams illustrating how the main antenna 111 and the supplementary antenna 101 become electromagnetically coupled according to a third embodiment of the present invention.
Figure 1E:
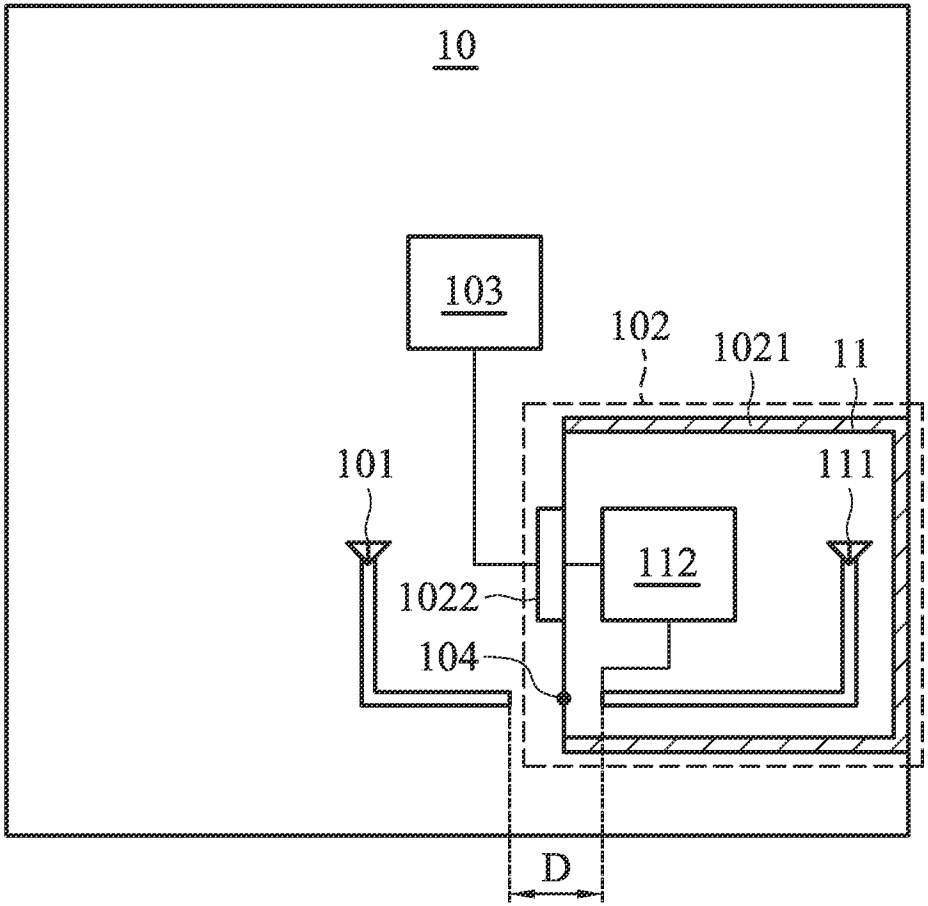

FIG. 1D and FIG. 1E are schematic diagrams illustrating how the main antenna 111 and the supplementary antenna 101 become electromagnetically coupled according to a third embodiment of the present invention. As shown in FIG. 1D of the third embodiment of the present invention, the socket 102 further comprises a first contact point 104.

Then as shown in FIG. 1E of the second embodiment, when the wireless communication module 11 is completely inserted into the accommodating portion 1021 of the socket 102, the wireless communication module 11 touches the first contact point 104 of the socket 102 so that the main antenna 111 keeps a predetermined distance D with the supplementary antenna 101 for realizing non-contact electromagnetic coupling. Accordingly, in the third embodiment of the present invention, the main antenna 111 and the supplementary antenna 101 are electromagnetically coupled by way of a non-contact electromagnetic coupling.

Figure 1F:
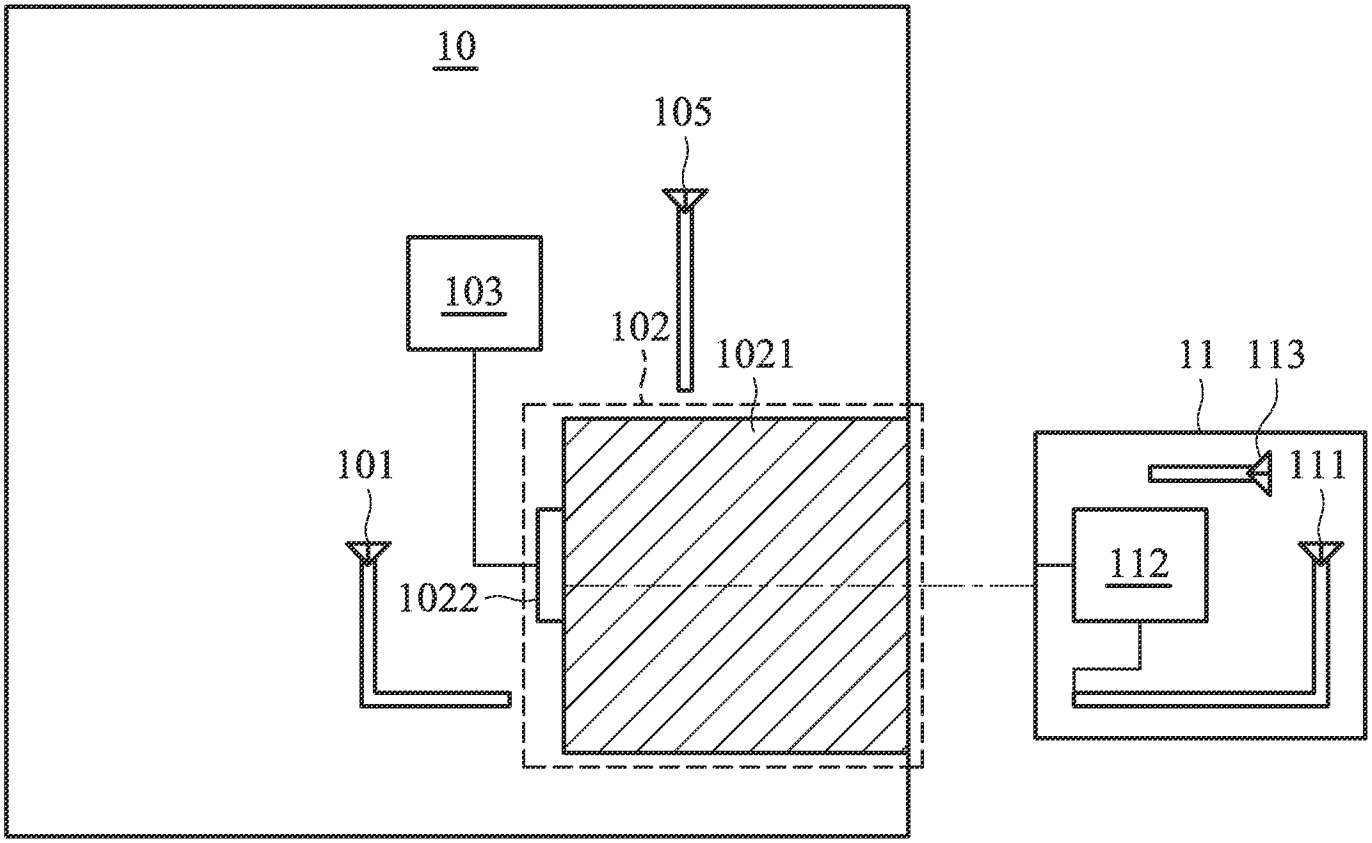
FIG. 1F is a block diagram showing the electronic device 10 and the wireless communication module 11 according to a fourth embodiment of the present invention.

FIG. 1F is a block diagram showing the electronic device 10 and the wireless communication module 11 according to a fourth embodiment of the present invention. The difference between the first embodiment shown in FIG. 1A and the fourth embodiment shown in FIG. 1F is that the electronic device 10 of FIG. 1F further comprises a second supplementary antenna 105, and the wireless communication module 11 of FIG. 1F further comprises a second main antenna 113, wherein the supplementary antenna 105 is disposed in the electronic device 10 (i.e., disposed inside the electronic device 10). In the fourth embodiment, the wireless communication module 11 supports MIMO (Multi-input Multi-output) communication.

In the fourth embodiment, when the wireless communication module 11 is completely inserted into the accommodating portion 1021 of the socket 102, the main antenna 111 of the wireless communication module 11 and the supplementary antenna 101 are electromagnetically coupled, and the second main antenna 113 of the wireless communication module 11 and the second supplementary antenna 105 are independently also electromagnetically coupled. In the fourth embodiment, the main antenna 111 and the supplementary antenna 101 are coupled electromagnetically in one of two ways: by direct electrical connection, or a non-contact electromagnetic coupling. The electromagnetic coupling of the second main antenna 113 and the second supplementary antenna 105 is also achieved by either a direct electrical connection or a non-contact electromagnetic coupling. In the fourth embodiment, the electronic device 10 respectively transmits/receives wireless signals using "the main antenna 111 and the supplementary antenna 101" and "the second main antenna 113 and the second supplementary antenna 105". Accordingly, in the fourth embodiment, the electronic device 10 enhances the antenna gain of the 2×2 MIMO communication system by using "the main antenna 111 and the supplementary antenna 101" and "the second main antenna 113 and the second supplementary antenna 105".

Figure 2:
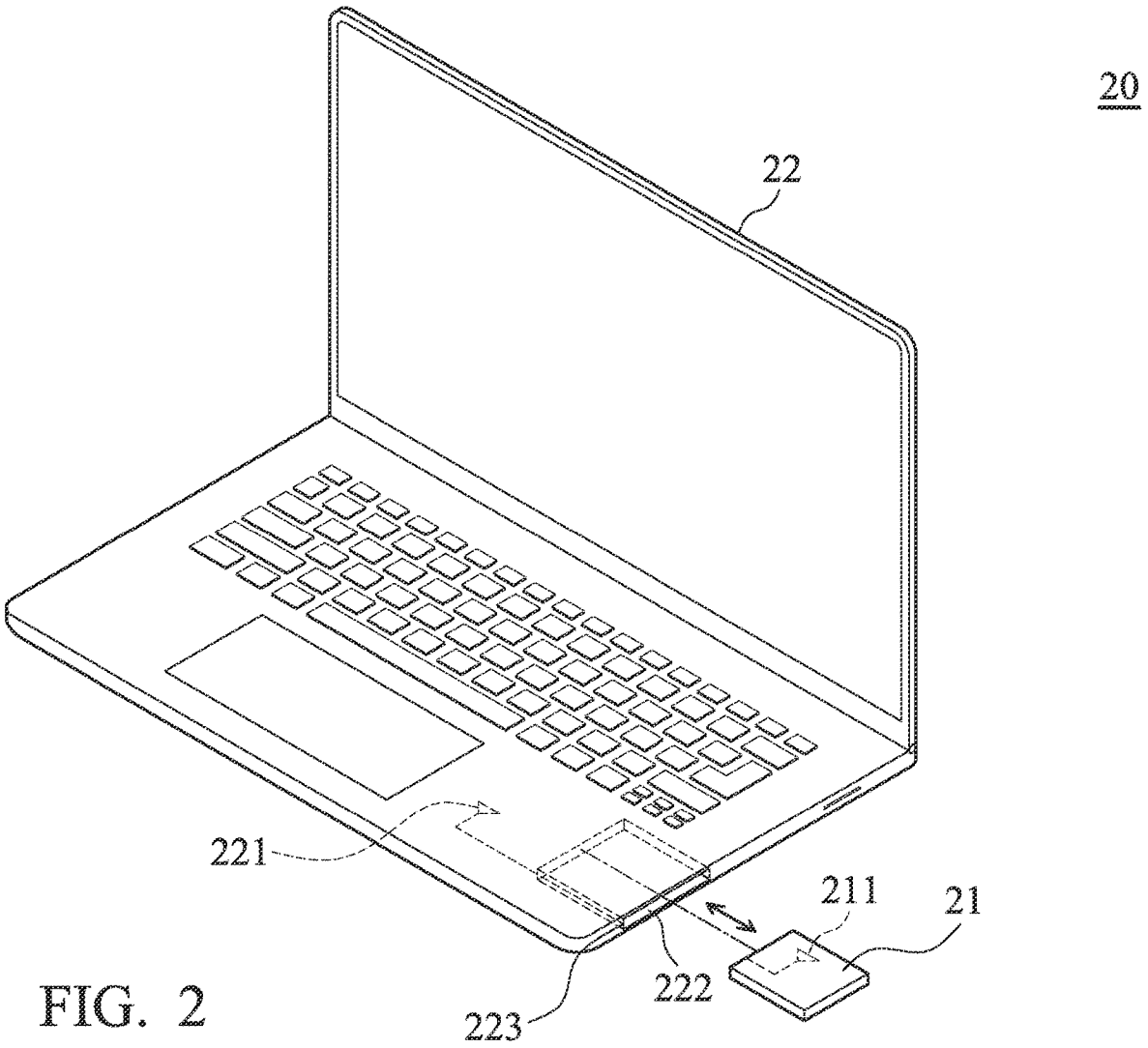
FIG. 2 is a block diagram showing a communication device 20 according to a fifth embodiment of the present invention.

FIG. 2 is a block diagram showing a communication device 20 according to a fifth embodiment of the present invention. In the fifth embodiment, the communication device 20 comprises a detachable wireless communication module 21 and an electronic device 22. The detachable wireless communication module 21 comprises a main antenna 211 and the electronic device 22 comprises a supplementary antenna 221 and a socket 222. In the fifth embodiment, the electronic device 22 can be a notebook, and the socket 222 can be a USB socket, but the present invention is not limited thereto. The detachable wireless communication module 21 further comprises a radio frequency module (not shown) used to process electromagnetic signals received from the antenna (for example, an equivalent antenna of the main antenna 111 and the supplementary antenna 101 being electromagnetically coupled) or used to control the antenna to transmit electromagnetic signals. In the fifth embodiment, the socket 222 is disposed on the electronic device 22 and electrically connected to the external detachable wireless communication module 21. In addition, the space of a notch of the socket 222 can completely accommodate the detachable wireless communication module 21. The supplementary antenna 221 is disposed in the electronic device 22. In the fifth embodiment, when the detachable wireless communication module 21 is completely inserted into the socket 222, the main antenna 211 of the detachable wireless communication module 21 and the supplementary antenna 221 become electromagnetically coupled. At this moment, the communication device 20 transmits/receives wireless signals using the main antenna 211 together with the supplementary antenna 221. In the fifth embodiment, the main antenna 211 and the supplementary antenna 221 are electromagnetically coupled via one of two possible methods: direct electrical connection, and non-contact electromagnetic coupling.

Figure 3:
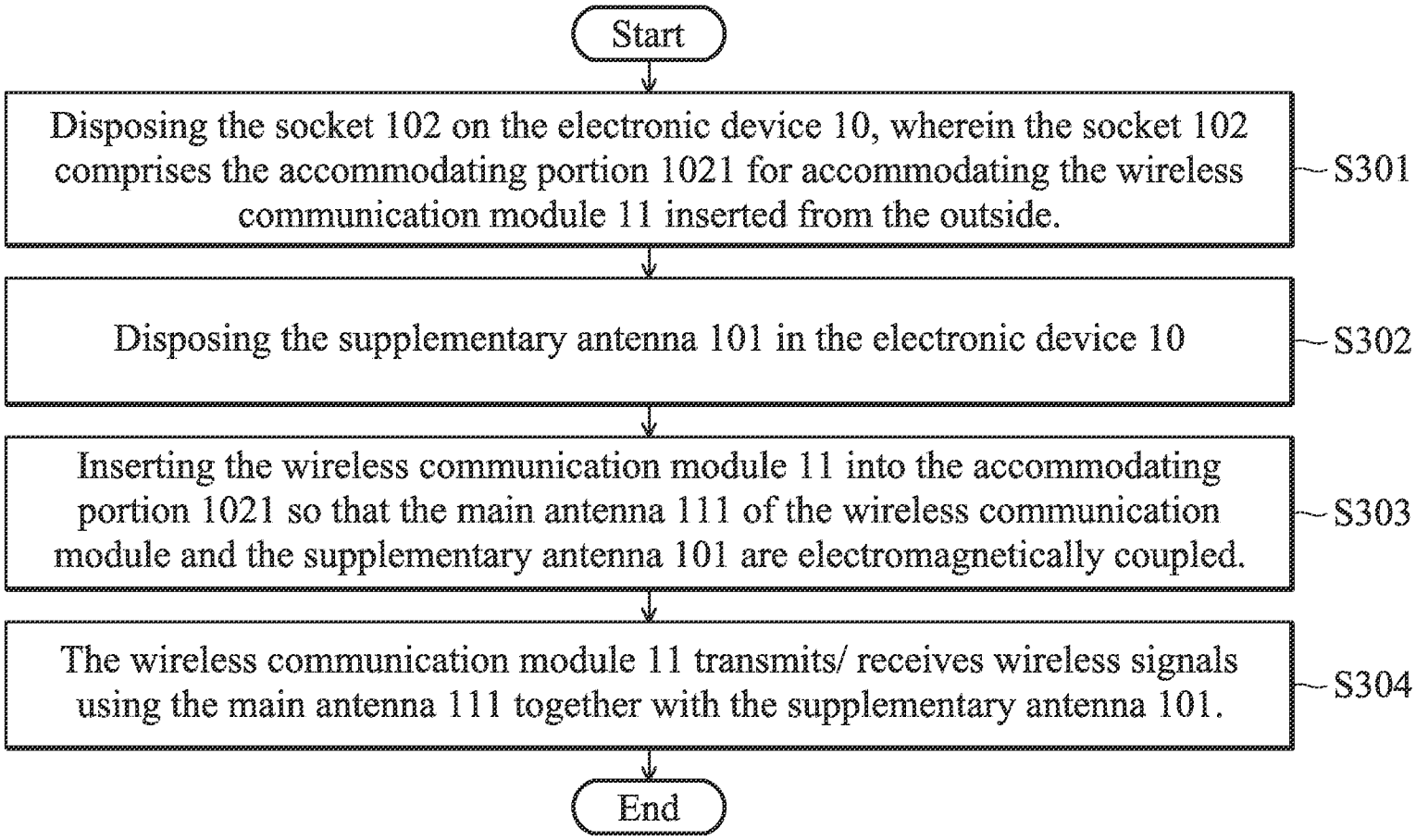
FIG. 3 shows a flow diagram to illustrate an antenna gain enhancement method for a detachable wireless communication module according to a sixth embodiment of the present invention.

FIG. 3 shows a flow diagram to illustrate an antenna gain enhancement method for a detachable wireless communication module according to a sixth embodiment of the present invention. In step S301, the socket 102 is disposed on the electronic device 10, wherein the socket 102 comprises the accommodating portion 1021 for accommodating the wireless communication module 11 inserted from the outside. Step S302 involves disposing the supplementary antenna 101 in the electronic device 10. Step S303 involves inserting the wireless communication module 11 into the accommodating portion 1021 so that the main antenna 111 of the wireless communication module and the supplementary antenna 101 are electromagnetically coupled. Finally, in step S304, the wireless communication module 11 transmits/receives wireless signals using the main antenna 111 together with the supplementary antenna 101.

Various aspects of the disclosure have been described above. It should be apparent that the teachings herein may be embodied in a wide variety of forms and that any specific structure, function, or both being disclosed herein is merely representative. Based on the teachings herein one skilled in the art should appreciate that an aspect disclosed herein may be implemented independently of any other aspects and that two or more of these aspects may be combined in various ways. For example, an apparatus may be implemented or a method may be practiced using any number of the aspects set forth herein. In addition, such an apparatus may be implemented or such a method may be practiced using another structure, functionality, or structure and functionality in addition to or other than one or more of the aspects set forth herein.

While the present disclosure has been described by way of example and in terms of preferred embodiment, it should be understood that the present disclosure is not limited thereto. On the contrary, it is intended to cover various modifications and similar arrangements (as would be apparent to a person skilled in the art). Therefore, the scope of the appended claims should be accorded the broadest interpretation so as to encompass all such modifications and similar arrangements.

What is claimed is:

1. An electronic device, comprising:

a socket disposed on the electronic device, wherein the socket comprises an accommodating portion for accommodating an external wireless communication module inserted from the outside; and a supplementary antenna disposed in the electronic device, wherein when the external wireless communication module is completely inserted into the accommodating portion, a main antenna of the external wireless communication module and the supplementary antenna become electromagnetically coupled; and wherein when the external wireless communication module is completely inserted into the accommodating portion, the electronic device transmits/receives wireless signals via the main antenna together with the supplementary antenna;

wherein the socket further comprises:

a first contact point, wherein when the external wireless communication module is completely inserted into the accommodating portion, the external wireless communication module touches the first contact point so that the main antenna keeps a predetermined distance from the supplementary antenna for realizing non-contact electromagnetic coupling.

2. A communication device, comprising:

a detachable wireless communication module having a main antenna; and an electronic device, comprising:

a socket disposed on the electronic device, wherein the socket comprises an accommodating portion for accommodating the detachable wireless communication module inserted from the outside; and a supplementary antenna disposed in the electronic device, wherein when the detachable wireless communication module is completely inserted into the accommodating portion, a main antenna of the detachable wireless communication module and the supplementary antenna become electromagnetically coupled; and wherein when the detachable wireless communication module is completely inserted into the accommodating portion, the communication device transmits/receives wireless signals using the main antenna together with the supplementary antenna;

wherein the socket further comprises:

a first contact point, wherein when the detachable wireless communication module is completely inserted into the accommodating portion, the detachable wireless communication module touches the first contact point so that the main antenna keeps a predetermined distance from the supplementary antenna for realizing non-contact electromagnetic coupling.

3. An antenna gain enhancement method for a detachable wireless communication module, comprising:

disposing a socket on an electronic device, wherein the socket comprises an accommodating portion for accommodating the detachable wireless communication module inserted from the outside;

disposing a supplementary antenna in the electronic device; and inserting the detachable wireless communication module into the accommodating portion so that a main antenna of the detachable wireless communication module and the supplementary antenna jointly become electromagnetically coupled, wherein when the detachable wireless communication module is completely inserted into the accommodating portion, the detachable wireless communication module transmits/receives wireless signals using the main antenna together with the supplementary antenna;

wherein the electromagnetic coupling further comprises:

disposing a first contact point on the socket; and completely inserting the detachable wireless communication module into the accommodating portion to touch the first contact point of the socket so that the main antenna keeps a predetermined distance from the supplementary antenna for non-contact electromagnetic coupling.

* * * * *